United States Patent [19]

Tooker

[11] 4,204,312

[45] May 27, 1980

[54] METHOD AND APPARATUS FOR JOINING A TUBULAR ELEMENT TO A SUPPORT

[75] Inventor: Philip G. Tooker, Snitterfield Nr. Stratford-upon-Avon, England

[73] Assignee: Serck Industries Limited, England

[21] Appl. No.: 873,887

[22] Filed: Jan. 31, 1978

[30] Foreign Application Priority Data

Feb. 11, 1977 [GB] United Kingdom ..... 5868/77

[51] Int. Cl.[2] ..... B21D 39/00; B23P 11/00; B23P 11/02

[52] U.S. Cl. ..... 29/523; 29/157.4; 29/243.52

[58] Field of Search ..... 29/523, 157.4, DIG. 46, 29/243.52

[56] References Cited

U.S. PATENT DOCUMENTS

| | | | |
|---|---|---|---|
| 1,166,040 | 12/1915 | Burlingham | 29/DIG. 46 UX |
| 1,647,447 | 11/1927 | Hartnett | 29/523 UX |
| 1,753,677 | 4/1930 | Andresen | 29/243.52 X |
| 2,482,490 | 9/1949 | Kaas | 29/523 UX |
| 2,939,251 | 6/1960 | Greening | 29/DIG. 46 UX |
| 3,166,828 | 1/1965 | Tupper | 29/523 X |
| 3,224,086 | 12/1965 | Balamuth | 29/DIG. 46 UX |
| 3,428,338 | 2/1969 | Corwin | 29/523 X |

*Primary Examiner*—Charlie T. Moon
*Attorney, Agent, or Firm*—Staas & Halsey

[57] ABSTRACT

The invention provides method of securing a tubular element such as a heat exchange tube to a support such as a tube plate. The method involves inserting an oversize ultrasonically vibrating tool therein to expand the element outwardly against the internal wall of the aperture. The invention also provides apparatus for carrying out the method.

12 Claims, 8 Drawing Figures

METHOD AND APPARATUS FOR JOINING A TUBULAR ELEMENT TO A SUPPORT

BACKGROUND AND SUMMARY OF INVENTION

This invention relates to a method of securing a tubular element of any desired cross-section into an aperture in a support and has particular but not exclusive application to the securing together of tubes and tube plates in the formation of heat exchangers. The invention also embraces apparatus for performing the aforesaid method.

Conventional methods of securing together tubes and tube plates employ techniques such as fusion welding, brazing or soldering, or various mechanical processes such as roller expansion, drifting with the aid of an oversize tool to expand the tube, or rivetting. Although some of these methods are widely used in industry and are thought to be generally satisfactory, they can give rise to such problems as lack of the necessary high joint integrity, residual corrosive products of the joining process which have to be removed, and excessive space requirements.

An object of the invention is to provide a method of and apparatus for securing a tubular element into an aperture in a support in which the aforesaid problems are alleviated or avoided.

According to the invention, a method of securing a tubular element into an aperture in a support, comprises the steps of inserting the tubular element into said support aperture, bringing an ultrasonic vibratory tool, of maximum transverse dimension slightly greater than the internal maximum transverse dimension of the bore of the element, into axial alignment with the bore, and, with the element axially supported, applying axial force to the tool whilst vibrating it ultrasonically so as to move it into the bore and expand the element outwardly against the wall of said aperture.

In a particularly effective form of the method, a counterbore is formed in the end portion of the support aperture facing the tool and the element is expanded into the counterbore.

From another aspect of the invention, apparatus for carrying out the aforesaid method comprises means for rigidly holding a tube support in a desired position, means for supporting a tubular element with an end portion thereof within an aperture of the tube support, a tool of maximum external dimension of the element, means for vibrating the tool ultrasonically, means for applying a force to the tool in a direction longitudinally of the element, and abutment means for engagement by the element to provide a reaction to said force during application of the tool to the element to expand the latter.

BRIEF DESCRIPTION OF THE DRAWINGS

The invention will now be described, by way of example, with reference to the accompanying drawings in which.

DESCRIPTION OF THE PREFERRED EMBODIMENT

Figure 1:
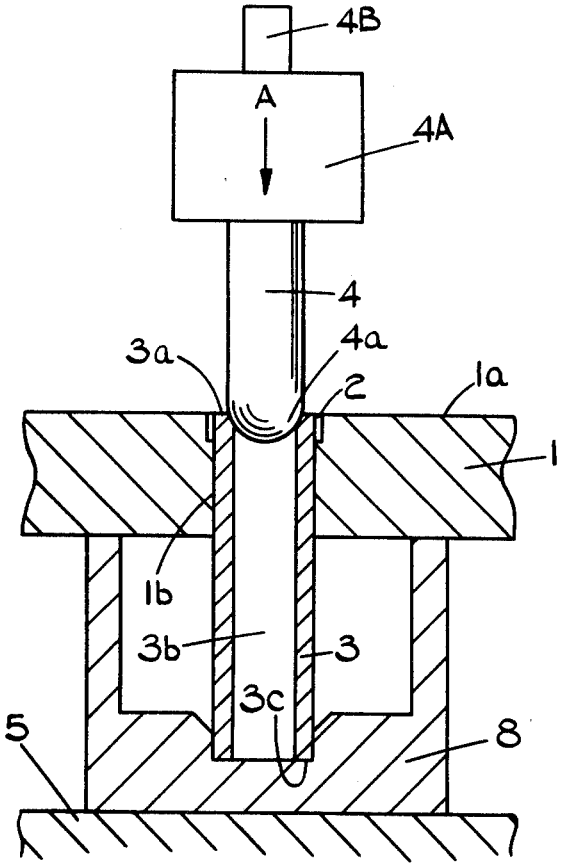
FIG. 1 illustrates diagrammatically apparatus used in the performance of the method of the invention in one stage of operation.

Referring to FIG. 1, this shows part of a support in the form of a heat exchanger tube plate 1, a surface 1*a* of which will form the outer surface of the tube plate in a completed heat exchanger assembly. The tube plate 1 has a through bore 1*b* and a counterbore 2 opening into the surface 1*a*. A tubular element in the form of a cylindrical heat exchanger tube 3 is shown positioned in the bore 1*b* with its end 3*a* flush with or slightly higher than the surface 1*a*, the external diameter of the tube 3 being less than the internal diameter of the bore 1*b*. An ultrasonic tool 4 secured to an ultrasonic vibrator 4A, itself mounted via a shaft 4B into a machine tool chuck for example, is placed in axial alignment with the internal bore 3*b* of the tube 3, the external diameter of the tool 4 being slightly greater than the diameter of the bore 3*b*. The end portion 4*a* of the tool is shaped to facilitate entry of the tool into the bore 3*b* and although shown rounded, this end portion may be shaped in any other convenient way, such as by tapering for example. The end 3*c* of the tube 3 is supported in a jig 8 which receives the lower end portion of the tube and which is arranged to locate the tube end 3*a* level with the tubeplate surface 1*a*. The jig itself rests on a fixed abutment or support 5 which may conveniently be a work table of the machine tool.

Figure 2:
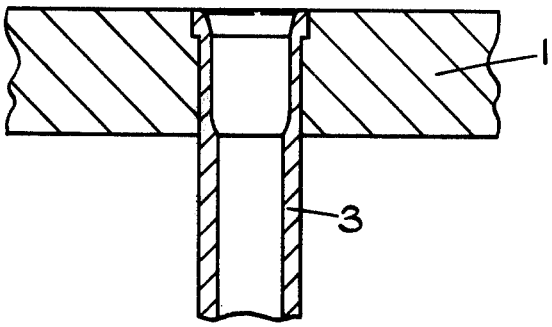
FIG. 2 shows to an enlarged scale part of a tube plate assembly produced by carrying out the method as illustrated in FIG. 1.

In order to join the tube 3 to the tube plate 1 by the method of the invention, the various parts are arranged as shown in FIG. 1 and, with a small axial force applied to the tool 4 in the direction indicated by the arrow A, the tool is ultrasonically excited in the axial direction and moves downwardly into the tube causing the latter to expand outwardly to fill the bore 1*b* and counter bore 2. The tool is then withdrawn, leaving the tube 3 securely attached to the tube plate 1 as shown in FIG. 2. The joint produced may be either purely a mechanical interlock or a fusion weld, or a combination of both, depending on the intensity of vibration employed and the materials used for the tube and tube plate.

Withdrawal of the tool 4 is facilitated by maintaining the ultrasonic excitation until the tool has been removed. A suitable lubricant may be applied to the tool 4 and/or bore 3*b* to facilitate penetration and withdrawal of the tool. The use of the counterbore 2 has been found particularly advantageous since, without this, splitting or cracking of the tube end can occur in some circumstances.

When the method of the invention is applied to the manufacture of a heat exchanger tube stack in which a plurality of tubes are provided and both end portions of each tube 3 are secured to respective tube plates 1, the method can be effected by inserting probes 4 in opposition in either end of each tube, so that each provides reaction against the axial forces generated by the other and a separate abutment 5 is then not necessary. It will be appreciated that, in all the embodiments described above and hereafter, a plurality of probes 4, attached to a suitable excitation head, can be used simultaneously to secure some or all of the required tubes in the tube plates of a tube stack in a single operation.

Figure 3:
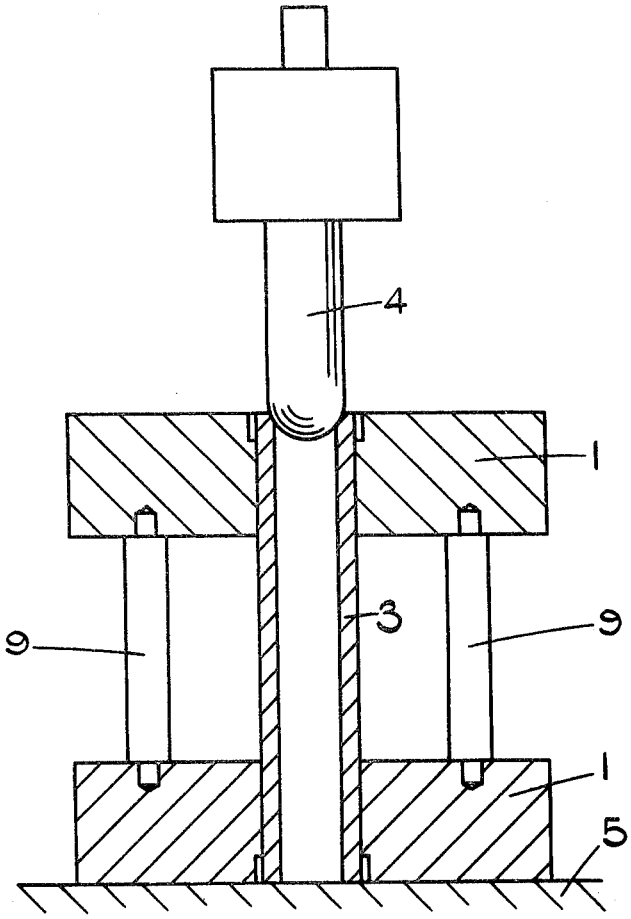
FIG. 3 illustrates apparatus used in performing an alternative form of the method of the invention.

An alternative manner of securing one or more tubes to respective spaced tube plates is illustrated in FIG. 3. In this case, spacers 9 are provided to engage both tube plates 1 and maintain them in a desired axial alignment, enabling tubes 3 to be secured to the tube plates in the manner described above. One of the plates 1 and the lower end of each tube 3 are supported directly on the fixed abutment 5 and, after fixing the tube or tubes to the upper plate 1 and with the probe 4 withdrawn, the assembly is inverted to enable a similar operation to be performed on the formerly lower plate 1.

Figure 4:
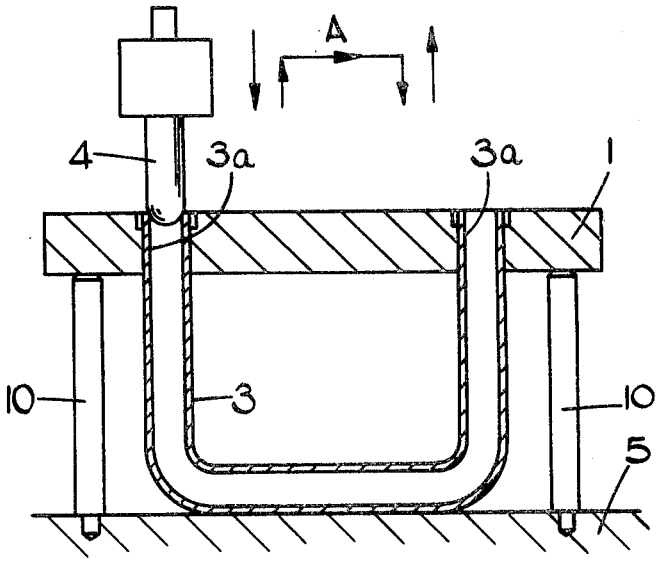
FIG. 4 illustrates apparatus used in performing a further alternative form of the method of the invention.

FIG. 4 shows the formation of a heat exchanger tube stack using U-shaped tubes, the free end portions 3*a* of which are secured to a common tube plate 1. Spacers 10 are provided, similar to the spacers 9 in FIG. 3, but in this case, the lower ends are engaged in the fixed abutment 5 and the tube plate rests on the top ends of the spacers, although these ends could be shaped to engage the tube plate 1, if desired. As shown, the probe 4 is inserted first into one end portion 3*a* to secure it to the tube plate, and is then withdrawn, moved in translation, introduced into the other end portion 3*a* and again withdrawn. These movements are indicated by the arrows A. Both end portions may, however, be secured simultaneously using a pair of probes and it would also be possible to secure simultaneously a plurality of tubes, as mentioned above.

Figure 5:
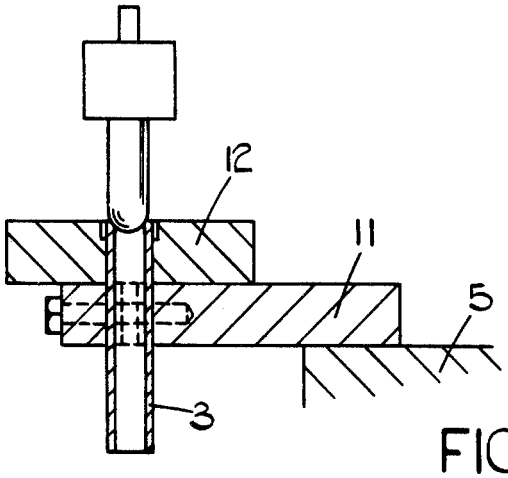
FIGS. 5 and 5A illustrate apparatus used in performing a yet further alternative form of the method of the invention.
Figure 5A:
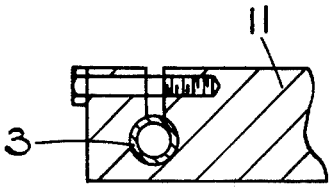

FIGS. 5 and 5A illustrate an alternative form of apparatus for securing a tube into an aperture in a support, the tube, in this case, being held in a clamping arm 11 fixed to the fixed support 5 and the tube plate 12 being placed upon the arm 11 over the end portion of a tube 3 to be secured to the tube plate. The actual securing of the tube to the tube plate, using an ultrasonically vibrating probe 4 is as described previously.

Figure 6A:
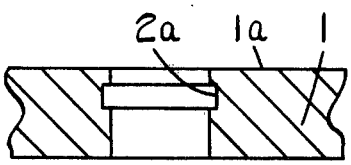
FIGS. 6A and 6B are fragmentary views of respective supports into which a tubular element is to be fixed by the method of the invention.
Figure 6B:
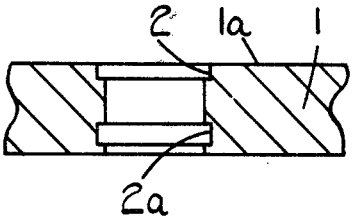

Referring to FIGS. 6A and 6B, these show alternative arrangements of grooves and counterbores in the tube plate 1. FIG. 6A illustrates the provision of an annular groove 2*a* spaced inwardly along the bore 1*b* from the surface 1*a*. During insertion of the tool 4*a*, the material of the tube 3 is locally expanded into the groove 2*a*. It will be appreciated that many alternative formations may be used in place of the groove 2*a*; for example, it may be replaced by a plurality of part-annular formations, or by axially extending grooves or similar formations. As illustrated in FIG. 6B, use may be made of a counterbore 2 and annular groove 2*a* in the same tube plate bore and various other combinations of these formations with others may be used as desired.

The excitation means employed may be any conventional ultrasonic vibrator, such as an electro-mechanical transducer. The precise dimensions of the bore 1*b* and counterbore 2 in the tube plate 1, and those of the tool 4 are determined experimentally depending on the tube size and materials used, as are the ultrasonic frequency and load employed. Although the materials used in a tube stack would normally be metals, it is nevertheless possible by means of the invention to join non-metallic materials either to each other or to metals. The tubular elements employed may be of any convenient cross-section.

It is customary in the production of the tube plates used in heat exchangers to drill the tube holes to the required pattern using numerically controlled (N.C.) drilling machines. The method of the invention has a particular advantage in that the tool 4, and its associated vibration generator can be mounted in an N.C. machine, thus enabling the tube joining to be carried out on existing equipment and thereby contributing to a reduction of costs. The N.C. machine would normally drill the tube plates to form a desired pattern of holes, and the machine then performs the tube joining operation with ultrasonic vibrator tools arranged in the original drilling pattern.

I claim:

1. A method of securing a tubular element into an aperture in a member, the dimensions of the aperture being sufficient to allow the tubular element to be freely inserted therein, comprising the steps of freely inserting the tubular element into said member aperture with the end of the element being substantially flush with the surface of the member, bringing an ultrasonic vibratory tool, of maximum transverse dimension slightly greater than the internal maximum transverse dimension of the bore of the element, into axial alignment with the bore, no part of the tool having larger cross-sectional dimensions than the cross-sectional dimensions of said aperture, bringing the tool into contact with the element whilst the tool is not vibrating ultrasonically, supporting the element axially and applying axial force to the tool whilst vibrating it ultrasonically so as to move it into the bore and expand the element outwardly against the wall of said aperture without substantially moving the element axially, the axial force applied to the tool being insufficient in magnitude to substantially deform the element were the tool not vibrated ultrasonically, and withdrawing the tool from the element while continuing to vibrate it ultrasonically.

2. A method according to claim 1, further comprising the steps of forming a counterbore in an end portion of the member aperture facing the tool and expanding the element into the counterbore.

3. A method according to claim 1, further comprising the steps of forming at least one groove within the aperture and expanding the element into the at least one groove.

4. A method according to claim 3 wherein the step of forming at least one groove is accomplished by forming the at least one groove to extend peripherally or the aperture.

5. A method according to Claim 4 wherein the step of freely inserting the tubular element into the member aperture is accomplished by inserting a cylindrical tubular element into a circular aperture, and wherein the step of forming at least one groove is accomplished by forming at least one annular groove.

6. A method according to claim 1, wherein the step of applying axial force to the tool whilst vibrating it ultrasonically is accomplished by ultrasonically vibrating the tool axially thereof.

7. A method according to any one of the preceding claims, further comprising the step of securing the element to respective members at either end thereof, respective tools being inserted in opposition in either end of the tube, wherein each provides a reaction against the axial forces generated by the other.

8. A method according to any one of claims 1 to 6 wherein the tubular element is generally U-shaped, and further comprising the step of connecting both free ends thereof to a single member.

9. A method according to any of claims 1 to 6 wherein the element is secured to respective members at either end thereof, further comprising the step of holding the members apart at a desired spacing and supporting them axially at one end of the assembly during insertion of the tool into the element at the other end, and the step of inverting the assembly and supporting it at said other end during insertion of the tool into the element at said one end.

10. Apparatus for securing a tubular element into an aperture in a member, the dimensions of the aperture being sufficient to allow the element to be freely inserted therein, comprising means for rigidly holding the member in a desired position, means for supporting a tubular element with an end portion thereof within an aperture of the member and with the end of the element substantially flush with the surface of the member, a tool of maximum external dimension greater than the maximum internal dimension of the element, no part of the tool having larger cross-sectional dimensions than the cross-sectional dimensions of the aperture, means for vibrating the tool ultrasonically after the tool has been brought into contact with the element, means for applying a force to the tool in a direction longitudinally of the element without substantially moving the element axially, the force applied to the tool being insufficient in magnitude to substantially deform the element were the tool not vibrated ultrasonically, abutment means for engagement by the element to provide a reaction to said force during application of the tool to the element to expand the latter, and means for discontinuing ultrasonic vibration of the tool after the element has been expanded and the tool has been withdrawn therefrom.

11. Apparatus according to claim 10 for joining the tubular element into respective apertures in a pair of members spaced axially of the element including spacer means for supporting the members at the desired axial spacing during insertion of the tool into the tubular element.

12. Apparatus according to claim 10 for joining the tubular element into an aperture in a member and including clamping means for clamping onto the element to retain the latter in correct alignment in relation to the aperture in the member, the clamping means being fixed with respect to said abutment means.

* * * * *